United States Patent [19]

Lambert

[11] Patent Number: 4,527,801

[45] Date of Patent: Jul. 9, 1985

[54] FLYABLE BALL AND FUNNEL APPARATUS

[76] Inventor: Theodore J. Lambert, 742 Lampson St., Apt. 401, Victoria, B.C., Canada, V9A 6A6

[21] Appl. No.: 500,790

[22] Filed: Jun. 3, 1983

[30] Foreign Application Priority Data

Jun. 28, 1982 [CA] Canada ..... 406092

[51] Int. Cl.[3] ..... A63B 71/00

[52] U.S. Cl. ..... 273/323

[58] Field of Search ..... 273/317, 318, 319, 320, 273/321, 323, 328, 329, 330, 331, 326; 46/74 R, 74 A, 74 B; 124/56

[56] References Cited

U.S. PATENT DOCUMENTS

| | | | |
|---|---|---|---|
| 986,157 | 3/1911 | Fleming | 273/326 |
| 2,194,761 | 3/1940 | Maihack | 273/328 X |
| 2,754,123 | 7/1956 | Davidson | 273/321 |
| 3,078,099 | 2/1963 | Hyman | 273/328 |
| 3,315,964 | 4/1967 | Gagne | 273/321 |
| 3,586,329 | 6/1971 | Spreitzer | 273/328 |
| 3,887,184 | 6/1975 | Cavaliere | 273/328 |
| 4,084,820 | 4/1978 | Olson, Jr. | 124/56 X |

FOREIGN PATENT DOCUMENTS 1327814 4/1963 France .

*Primary Examiner*—William H. Grieb

[57] ABSTRACT

Amusement device, personal motor skills testing apparatus type, having handle perpendicular to axis of infundibular member from which handle extends, manually operable for lifting a freely movable playing ball to height from which ball is let to drop passing through central aperture of infundibular member, and constructed to have aerodynamic characteristics adapting it to be throwable as a toy aerodyne, with its handle serving as a fuselage, the infundibular member as its wing.

4 Claims, 7 Drawing Figures

FLYABLE BALL AND FUNNEL APPARATUS

This invention relates to an amusement device, manually operable to produce physical phenomena engaging the attention of operators and onlookers alike. Using the disclosed flyable ball and funnel apparatus and method, operators can achieve results not possible before this invention. Besides providing healthful fun, another object of the invention is to teach two new uses of a playing ball, causing it to move in new ways, yet without forcibly propelling it, thereby preserving it from deterioration from stresses. Also, unlike the case with implements in common implement and ball combinations, in this invention the implement has a proper use even if the ball with which it combines is gone.

Two classes of articles intended to be improved by this invention are: (one) toy throwable aerodynes; and (two) known devices for manipulation causing a ball to pass through an aperture on them, for amusement. Existing class (one) articles are useful for throwing them to land at a predetermined area, because they adapt means for attaining stable attitudes while in flight; for example, lawn darts have fins, balsa gliders have tails and wings, and flying discs have their shape and spinning manner of being operated. Although such means allow operators to anticipate projected trajectories, unfortunately, the velocity of aerodynes employing such means must be relatively high, to develop sufficient air pressure against the stabilising surfaces; consequently, common class (one) toys are airborne for less time proportionate to a given distance to a targeted landing point, than if they could be thrown to fly more slowly. To afford operators more enjoyment at watching their aerodynes take lengthier flights, timewise, in less extensive space, this invention supplies the needed improvement, allowing slower flight, while retaining directibility. Next, existing class (two) known amusement devices, namely, hand apparatus having an aperture through which a ball passes, commonly have said ball functioning as a projectile forcibly propelled by sundry special measures, such as by striking it like with paddling means to cause its rebound, by launching it from a grooved track or ramp guiding it towards its aperture target, or by pulling it about at the end of a tether. Such old devices are useful for a solitary individual to amuse himself, or herself, while repetitively exercising his or her basic motor skills abilities, at the task of operating them; too great an emphasis on means amounting to gadgetry and unduly complicated arrangements for propelling the ball, however, neglects unused characteristics of an apertured infundibular part, which these old devices employ primarily as passive receptable, albeit one serving well for easy retrieval of the ball, to positions from which it again can forcefully be projected; consequently, there is scant opportunity for operators of existing class (two) amusement devices to initiate improvisational movements, since their movements must be relatively constricted for deploying the gadgetry for forcibly propelling the ball. This invention provides an improved arrangement of parts, and a new method of operation, whereby a ball passes through an aperture without need of special means to propel it; improvisations are facilitated. Generally summarizing matters relating to two classes of articles to be improved: must toy aerodynes fly too far too fast for satisfactory throwing in less space; in amusement devices deploying fussy measures to forcibly propel a ball towards a hole, constrictive operation reduces improvisation.

I have found that an infundibular member has characteristics suiting it for adaptation for additional functions, in an amusement device, other than for merely letting a ball to pass through it. The flyable ball and funnel apparatus and method bases its solution of the abovementioned difficulties with class (one) and class (two) devices on two hitherto neglected characteristics of an infundibular member. The characteristic which is employed in this invention, to eliminate excess gadgetry and associated constricted manners of operation, was ignored in all the prior class (two) art: the inner surface of an infundibular member is adaptable for direct use to rest a ball thereupon, in order to lift up said ball, notwithstanding that it is known the ball would fall down through the infundibular member, if the device incorporating that member were held at an angle allowing the ball to do so. The obvious funnelling capability of an infundibular part, previously, has obscured and taught away from the use of it for lifting, which I propose. Employing an especially adapted infundibular member for lifting the ball up, I eliminate excess gadgetry for propelling said ball to its target receptacle. Gravity does the work of pulling the ball downwards, freely falling. Instead of being an essentially passive part, the infundibular member must be made to swoop down quickly, to get into a position under the falling ball, so as to lift it up again. The ball is never struck, pulled, or launched upwards, and it is allowed to drop through the infundibular part only when the operator lets it, the simple means of control being to either hold level, or to tilt, the line of the inner surface whereupon the ball rests, by manipulation of the apparatus. The second neglected characteristic of an infundibular member, which this invention employs, is that hollow truncated cones of material tend to stabilise themselves, apex end downwards, as they fall in a resistant medium such as air, thereby positioning their exterior surfaces correctly for reacting against deflected air to produce an upward component of force, to buoy them up, if a lateral movement of such cones were provided without tilting them. Thus, an infundibular member is adaptable as a variety of wing, the angle of attack of which is similar to what, in ordinary craft, would cause a stall. Not nearly as efficient in terms of distance travelled proportionate to altitude dropped, as a glider wing of conventional airfoil type would be, my infundibular wing means allows my toy aerodyne to stay in the air longer while on its way to a relatively near landing point, than can lawn darts, balsa gliders, or flying discs, given equivalent weights and throwing force applied. By utilising the two abovementioned characteristics of an infundibular member, adapting means as disclosed, for solving difficulties pertaining to special types of toys, this invention provides an extraordinarily useful combination of parts, which has the built-in advantage of encouraging a variety of actions to be performed by operators.

In drawings which illustrate embodiments of the invention,

FIG. 1 is a top plan view of one embodiment, showing a playing ball in crosshatched drawing, stowed in its cockpit, similarly as in FIG. 2, FIG. 3, and FIG. 5, FIG. 2 is a side elevation of the same embodiment, FIG. 3 is a bottom plan view of the same embodiment, FIG. 4 is a frontal perspective in partial section, the ball shown resting in a side aperture centring along line I-II held level, as it would be when lifting the ball, FIG. 5 is a front elevation of a slightly different embodiment, which has finlike extenions for landing legs.

Figure 1:
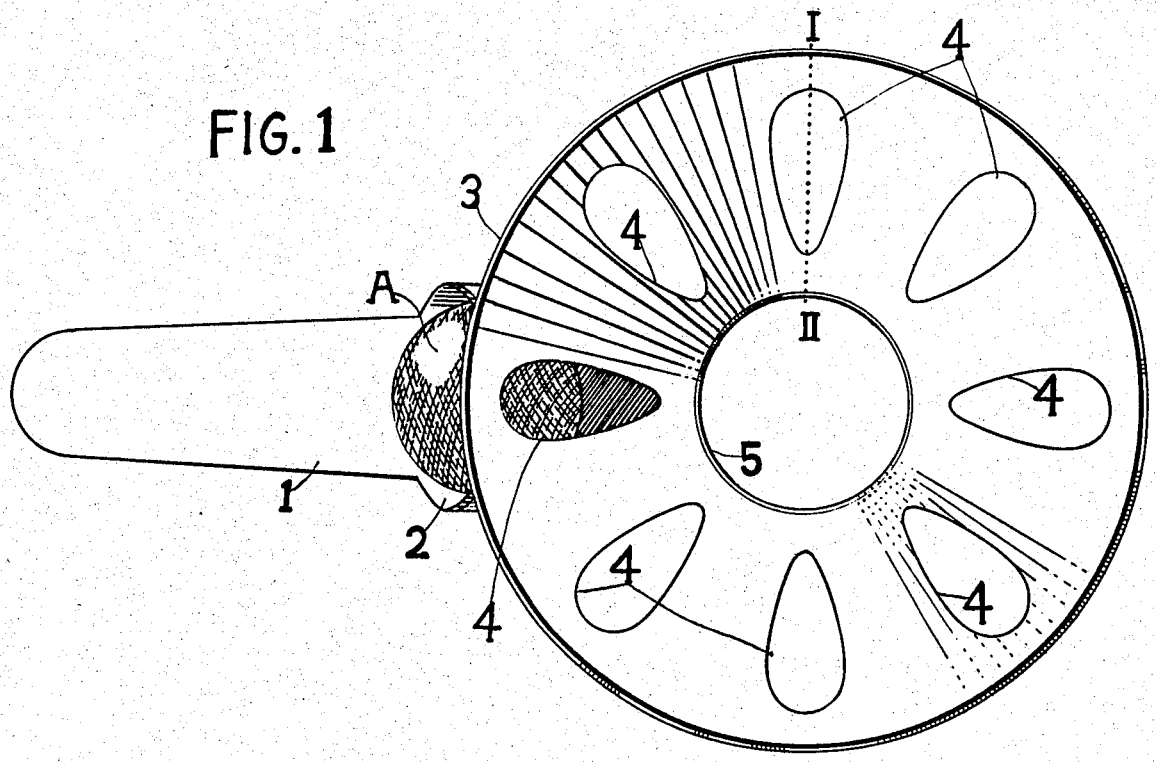
Figure 2:
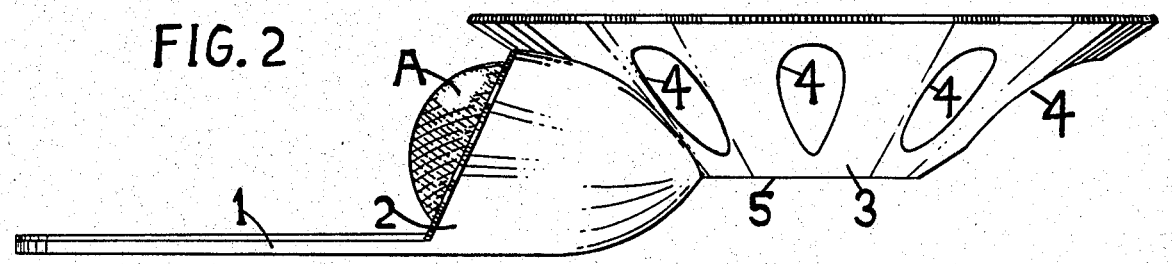
Figure 3:
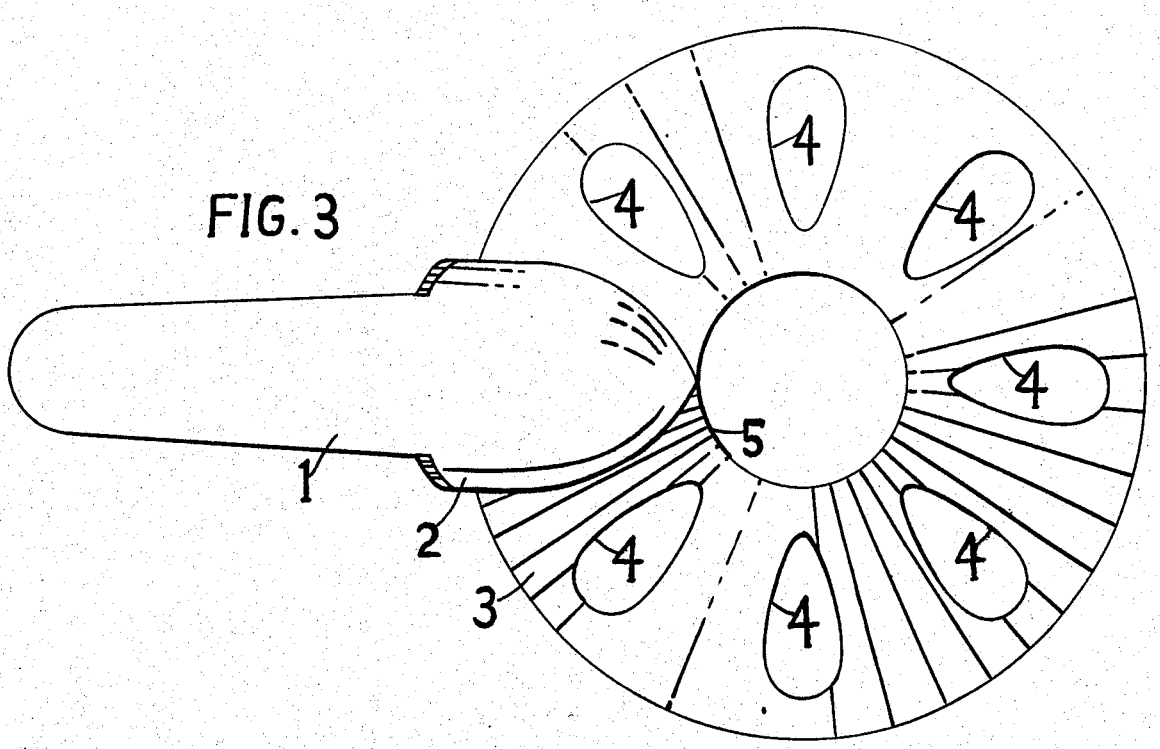
Figure 4:
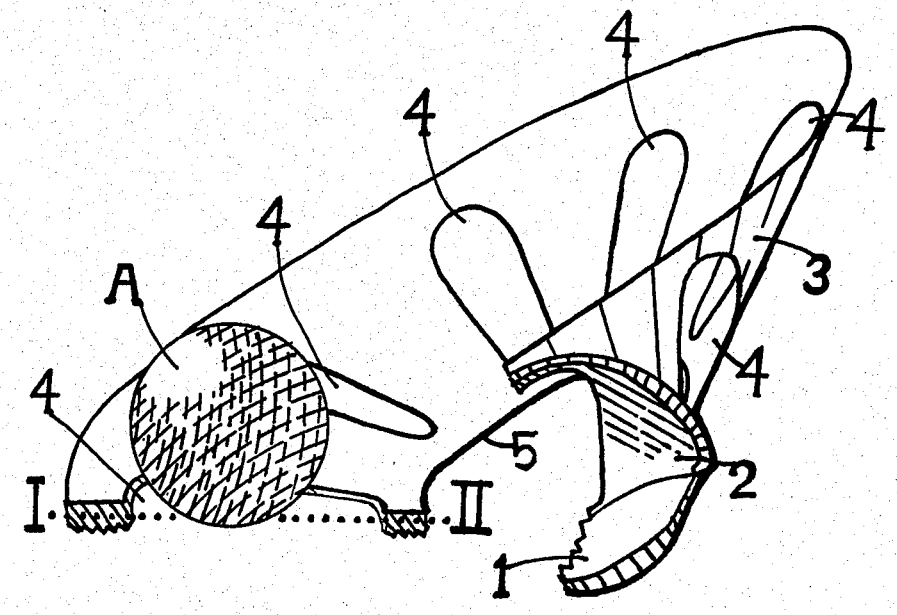
Figure 5:
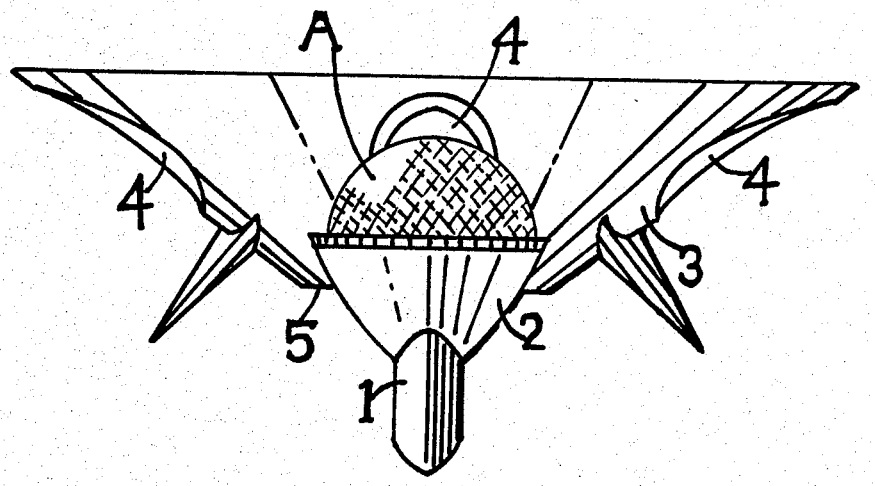
Figure 6:
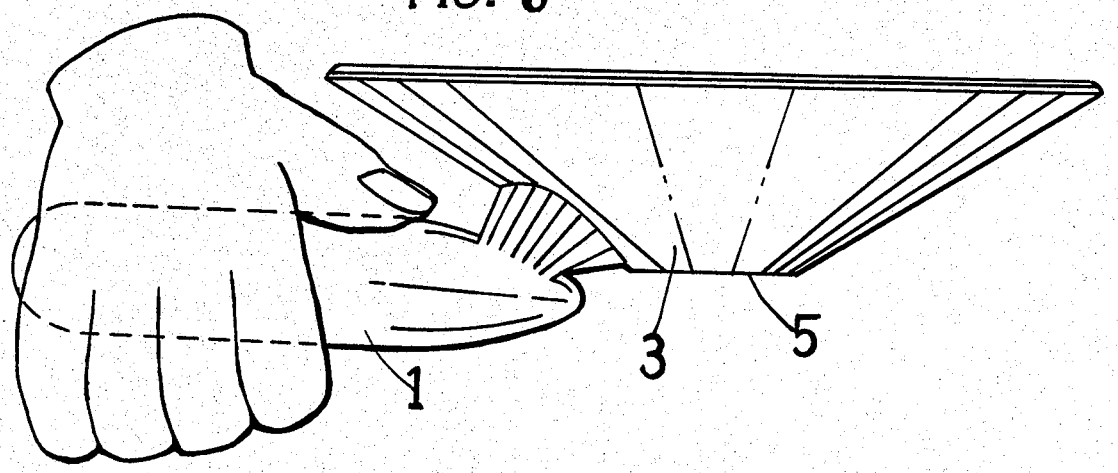
FIG. 6 is a side view showing hand position for ordinary funnelling.
Figure 7:
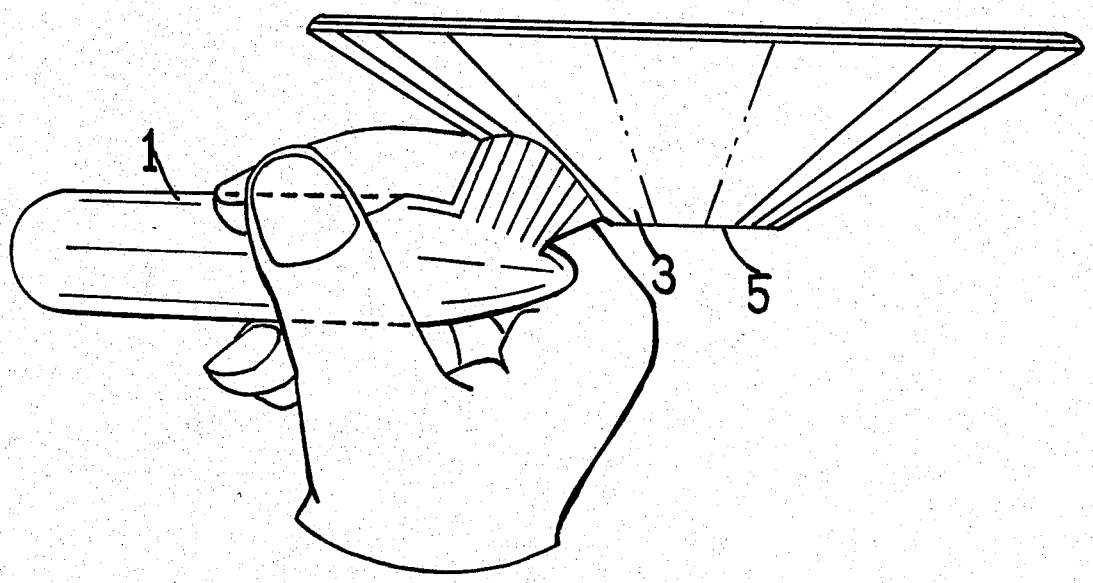
FIG. 7 is a side view showing hand position for throwing the apparatus in a spear-like manner.

The apparatus illustrated comprises a handle 1 which has a storage cockpit 2 formed to closely stow playing ball A, and a regular infundibular member 3 which has side apertures 4 regularly distributed around a central aperture 5. A line I-II represents any line extending radially from the circumference of aperture 5 to the outermost edge of member 3, though the one line I-II shown, in FIG. 1 and in FIG. 4, happens to bisect a side aperture 4. The implement shown can be fabricated either in one piece, by machining, forging, sheet-forming, or molding, in parts 1, 2, and 3 can be produced separately first, then joining them securely by welding, riveting, stitching, or glueing. Everything is secure, and materials like fiberglass, nylon, or polystyrene plastic can be used to make a fairly rigid and lightweight model. Metal, wood, or even rawhide could be used. It depends on the weight of the playing ball used, precisely how resistant to deformation the materials forming the infundibular member, in particular, need to be. Using a lightweight ball, the implement can be correspondingly less rigidly constructed, if desired. A heavier implement may be employed for exercise purposes, but then its use as a throwable aerodyne for relatively near landing points would require launching into high headwinds. Extremely dense apparatus can be used for throwing in a more resistant medium, for example, underwater. Apparatus having adjustable weight, for various occassions, are readily constructed using known techniques, such as filling or emptying hollow parts as desired. Blow-molded polyethylene models can be filled with water for heavier implements to lift and funnel a moderately lightweight ball, and then be emptied for throwing. Fabrication of many variations on the basic apparatus disclosed would be easy. Now, to operate the apparatus for amusement at lifting and at dropping the playing ball A, remove ball A from its cockpit 2. By means of handle 1 hold the implement out in front of oneself. Holding the implement at about waist height, tilt it so that a line I-II across the inner surface of member 3, radially extending, will be level for placing the ball A to rest intercepting that line. Supposing line I-II bisects a side aperture 4 when the levelling instruction is carried out, put ball A to ride therein, held by gravity and some friction. In an apparatus without side apertures, a ball can still be rested in place on the inner surface of member 3, if a line I-II is kept level under it. Mostly what side apertures do is to add some friction on the ball to ensure that it doesn't roll around unduly unless the line I-II under it is significantly off level for more than a mere instant; different means to serve the same auxiliary purpose, such as numerous short flexible protruberances all over the inner surface of member 3, or even just having a sticky surface, could substitute for the side apertures 4 which are illustrated. These apertures are not intended to be so large that the ball could lodge in them, of course. The provision of a sufficiently large surface area of an infundibular member 3, upon which a ball not yet brought under complete control might yet move about a bit without falling off, is more important than side apertures. What is the vital point is that the infundibular member 3 is adapted for keeping the ball to rest on its inner surface sometimes, and not merely for guiding it down to a sufficiently large central aperture that it passes out. A ball which inadvertently has been let to roll around too dangerously near to prematurely falling out of the member 3 can be brought under control by carefully manipulating the implement to get any radial line I-II coming under the ball to be level. Avoid striking the ball from underneath it, as much as can be avoided. Using the implement tilted to keep the ball on the infundibular member, lift the whole apparatus up from waist height to approximately chest height. Then will the moment come to let the ball funnel through central aperture 5. This is readily accomplished by turning the implement so that no radial line I-II across the inner surface of member 3 is level, and so that the higher end of every radial line I-II is at the outermost edge of member 3. Thus, by holding the implement as though it were an ordinary funnel, momentarily, the ball is let to drop from about chest height. Once ball A clears through aperture 5, one can quickly bring the implement swooping down, arcing slightly to one side so as to avoid inadvertently striking the freely falling ball while maneuvering to get the infundibular member 3 into position under the ball. One can easily cause the implement to travel downwards much faster than the ball can fall. Even so, do not delay too long after the ball has dropped out. But initiating the swooping downwards and arcing motion too abruptly, before the ball is completely clear through its aperture, can violently throw the ball away inadvertently, so avoid that error too. Getting the surface of member 3 under ball A before ball A can fall too low, then proceed to use no more force that required to stop its descent, and carry it up again riding on the tiltable infundibular member 3 as before. The sequence of lifting up, funnelling, and then swooping down to recover the ball, teaches a method of operation which serves as the basic action for many interesting variations and games. Contests to see who can funnel ball the most times without letting it hit the ground can be held. More than one person can play a game with the same ball, letting it fall from one implement into another. Either co-operative type or competitive type games can be played funnelling ball. A face-off game of two players defending adjacent sides of a line, wherein each player tries to drop the ball from a prescribed height onto the other player's side, is made interesting by the deception practised whereby one pretends to still move to funnel ball after it has been let go to strike. Operators can move around walking, dancing around, or running, at the same time they are funnelling, once basic proficiency at enacting the aforementioned method of operation is attained. The flyable characteristic of the invention makes play with an apparatus significantly more susceptible to voluntarily initiated variation, since operators tiring or otherwise motivated to cease their efforts at funnelling have immediate safe recourse to throw something. To throw the apparatus as a toy aerodyne, grasp the lower part of cockpit 2 from below, with the handle 1 pointing extended away from the hand. Raise the apparatus to about shoulder height, cocking the arm as for throwing a spear. With an overhand throwing action release the apparatus to sail forward through the air, its infundibular member 3 serving as an upswept variety of wing. A basic way to vary the distance the apparatus can practicably be thrown is to either leave the ball A in cockpit 2, for its weight when greater distances are to be traversed, or remove the ball so that the implement only is the aerodyne, for a lighter craft suitable for landing it more gently at nearer predeterminable target landing points. The ball A can be rolled out along the ground to place it as a target for practising accurate throwing. Notwithstanding the invention is usable in either of the abovementioned modes individually, the best manner of operation comtemplated involves the combination of both types of action. The apparatus is thrown into the air overhead, like an aerobatic stunt plane, and then it is caught or picked up subsequent to its descent, to be employed funnelling for a while, before throwing it up again. Alternatively, a race between two operators, each using the flyable ball and funnel apparatus and method in full, can be held, the ball must be cycled a set number of times without it hitting the ground, before the apparatus is sailed toward the goal. Where it lands is where its thrower has to funnel again before throwing it again, until the goal is reached.

I am aware that the specific apparatus described above resembles in some respects certain funnel-shaped ball-catching toys; they are not winged projectiles, however, and I limit myself to the invention as defined by the claims below

I claim:

1. A projectile apparatus characterized by attitude stability and support produced by deflecting surrounding fluid flow with an upright infundibular member forming a wing, comprising:

a wing formed by an upright infundibular member through which the vertical axis of said infundibular member orients generally perpendicular to the ground, said infundibular member having a concave upper side, a convex lower side, and a central aperture; and a forward projecting fuselage through which the longitudinal axis of said fuselage orients generally parallel with the ground, said fuselage having a free forward end, and a rear end near which said fuselage and said infundibular member are connected to one another.

2. The projectile apparatus recited in claim 1, in which construction is in a size and weight to permit throwing by hand.

3. The projectile apparatus recited in claim 2, further comprising a cockpit built into the said fuselage, said cockpit surrounding a space accessible for storage.

4. The projectile apparatus recited in claim 3, further comprising a playing ball removably stored in the said cockpit, said ball being of a size small enough to permit funnelling said ball down through the central aperture of the said infundibular member.

* * * * *